United States Patent [19]

Bernardet

[11] Patent Number: 4,924,138

[45] Date of Patent: May 8, 1990

[54] DEVICE COMPRISING A VACUUM ION ARC SOURCE

[75] Inventor: Henri Bernardet, Saint Michel Sur Orge, France

[73] Assignee: U.S. Philips Corporation, New York, N.Y.

[21] Appl. No.: 179,610

[22] Filed: Apr. 11, 1988

[30] Foreign Application Priority Data

Apr. 10, 1987 [FR] France ..... 87 05120

[51] Int. Cl.[5] ..... H05H 1/02; H05H 1/24

[52] U.S. Cl. ..... 313/361.1; 313/153; 313/424; 313/231.41

[58] Field of Search ..... 313/361.1, 424, 445, 313/359.1, 231.41, 153, 111.31, 360.1

[56] References Cited

U.S. PATENT DOCUMENTS

| | | | |
|---|---|---|---|
| 2,617,061 | 11/1952 | De Gier | 313/424 X |
| 2,836,752 | 5/1958 | Berthold | 313/424 |
| 2,921,212 | 1/1960 | Berthold | 313/424 |
| 3,393,339 | 7/1968 | Hill et al. | 313/359.1 X |
| 4,631,448 | 12/1986 | Tamura et al. | 315/111.81 |

*Primary Examiner*—Palmer C. DeMeo

*Attorney, Agent, or Firm*—Paul R. Miller

[57] ABSTRACT

A vacuum arc ion device having a plasma-emissive cathode and an anode, each being energized with suitable potentials, and having the further structure for eliminating micro drops of molten material which micro drops are emitted for certain materials during plasma formation.

9 Claims, 2 Drawing Sheets

DEVICE COMPRISING A VACUUM ION ARC SOURCE

The invention relates to a device comprising a vacuum arc ion source having a plasma-emissive cathode and an anode which can be energized with suitable potentials.

BACKGROUND OF THE INVENTION

When an ion arc is struck between the anode and the cathode, the material is locally atomized under the influence of the heating. The ionized gas causes a plasma which is formed by a mixture of ions and electrons having a total charge which is equal to zero. The ion arc is sometimes initiated by an auxiliary plasma between the anode and the cathode by means of an independent control electrode for a period of time which is short with respect to the length of the arc pulse.

The formation of the plasma with an average energy of a few tens of electron volts occurs from very bright spots of very small dimensions, which are termed cathode spots, and the plasma is in the form of a cone, the conical angle of which is approximately 30°.

For certain materials the plasma formation is associated with an emission of micro drops of molten material; and the emission is not isotropic and for the greater part is located in a solid angle near the surface of the cathode.

SUMMARY OF THE INVENTION

The invention is based on the recognition of the fact that the emitted micro drops can cause damage to the quality of the desired layer or the correct operation of the device comprising the ion source.

For that purpose, the device according to the invention comprises means to eliminate micro drops of molten material.

In one embodiment the means comprise receptacles. The receptacles preferably comprise surfaces on which the micro particles readily adhere. The adhesion can be improved by polarizing the receptacles with respect to the cathode.

In another embodiment in which the elimination of the splashing micro drops which are emitted in a solid angle near the surface of the cathode is sufficient, the receptacles comprise recessed spaces which are provided in the maximum emission zones of the micro particles (in which the directions make a small angle with the emissive surface of the plasma).

In still another embodiment the receptacles comprise a grating on gratings which are provided at the level of or beyond the anode in such a manner that a direct observation of the cathode from the extraction of the micro drops is avoided.

As a result of this a more complete elimination of the micro drops is obtained.

In a further embodiment the means comprise separation means to separate micro drops and plasma, which separation means provide a magnetic field to limit the plasma and which restricts the radial spreading of the plasma according to a rectilinear or curved track of ions.

BRIEF DESCRIPTION OF THE INVENTION

A few embodiments of the invention will now be described in greater detail, by way of example, with reference to a drawing, in which.

Figure 5A:
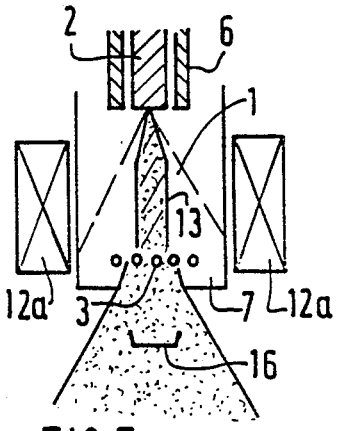
Figure 5B:
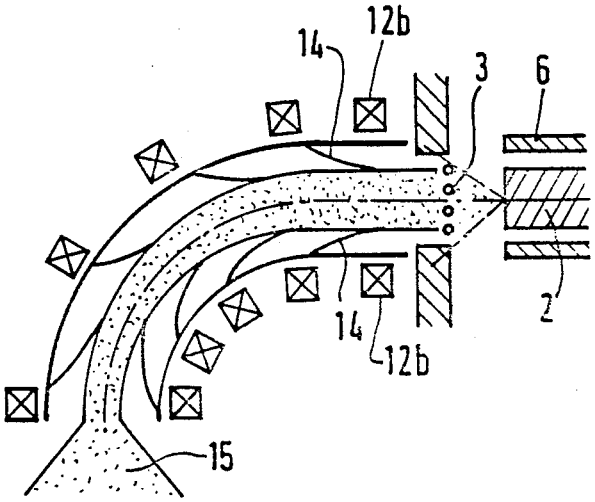

FIGS. 5*a* and 5*b* show an arrangement for separating the micro drops from the plasma by means of a magnetic field for a rectilinear (FIG. 5*a*) and a curved (FIG. 5*b*) track of the plasma.

DETAILED DESCRIPTION OF THE INVENTION

In these Figures, identical elements are usually referred to by the same reference numerals.

Figure 1:
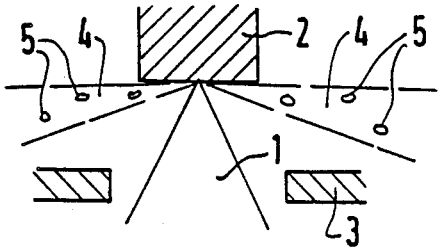
FIG. 1 shows the maximum emission zone of the micro drops.

FIG. 1 shows a plasma 1 which is emitted by a cathode 2 between the cathode and an anode 3. The maximum emission zone 4 of the micro drops 5 which is situated near the emission surface from the cathode of the plasma is bounded on the one hand by the emission surface of the plasma and on the other hand by a cone having a planar cross-section in the plane of FIG. 1 shown in broken lines.

Figure 2:
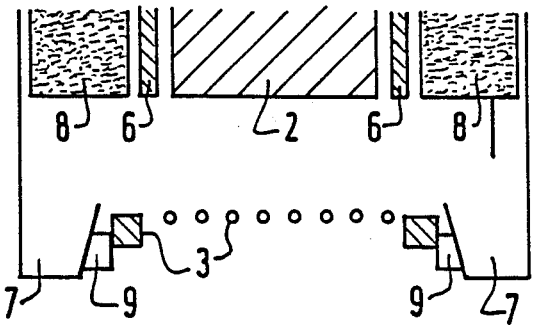
FIG. 2 shows an arrangement for eliminating the micro drops in their maximum emission zone.

In FIG. 2 the cylindrical cathode 2 is surrounded by a tube of the same shape which forms a control electrode 6. In this example the cathode is cylindrical which is not to be considered as being restrictive for the invention. The elimination of the micro drops is carried out in the maximum emission zone 4 shown in FIG. 1 by means of receptacles consisting of recessed spaces 7 which are insulated from the control electrode 6 and the anode 3 by means of the spacers 8 and 9, respectively. These recessed spaces 7 serve as receptacles for the micro drops. An improved adhesion of the micro drops is possible by a suitable surface treatment, which adhesion can even be improved by a polarization of the receptacle with respect to the cathode source with a polarization opposite to that of the electric charge of the micro drops.

Figure 3:
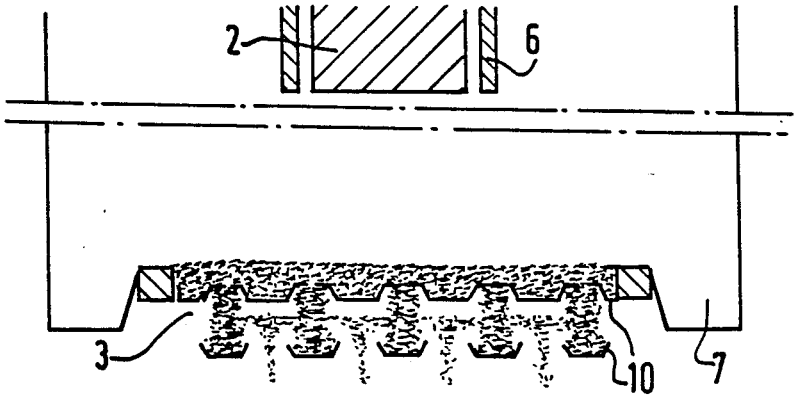
FIG. 3 shows an arrangement for eliminating the micro drops which comprises gratings.

In the case of applications in which a more complete elimination of the micro drops is necessary or desired, a system of receptacles may be added to the system 7 of FIG. 2 in the form of a grating or gratings 10 placed in the splashing zone of the plasma, as is shown in FIG. 3. The gratings are provided on the level of or beyond the anode 3 in such a manner that a direct observation of the extraction from the cathode is avoided; and they may be weakly polarized with respect to the source to promote an efficient collection of the micro drops, in which the electric charge of the micro drops is taken into account. In this example several gratings are shown. These gratings may be combined to form one grating.

The micro drops are intercepted by the gratings. They are better fixed thereon by adhesion when the surface of the gratings has been subjected to a treatment which improves the bonding. The retaining of the micro drops by gravity is facilitated when the cross-section of the gratings is in the form of a cup-shaped structure (which case is shown in FIG. 3).

Figure 4:
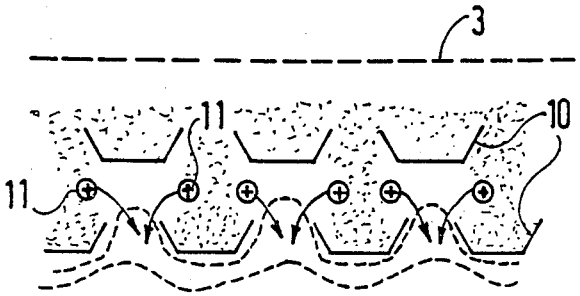
FIG. 4 illustrates the use of the gratings as ion extraction gratings.

The permeability of the gratings for the plasma is small because only ions 11 having a sufficient radial diffusion can be withdrawn (FIG. 4).

The permeability can be improved considerably by using the drawings as an extraction surface for the plasma which is spread via the system for eliminating the micro drops. In that case the gratings are provided beyond the anode.

A means to separate the micro drops and the plasma is shown in FIGS. 5*a* and 5*b*. It consists of the use of a magnetic field which encloses the plasma and is supplied by the induction coils 12*a* and 12*b*, respectively. The volume 1 of the plasma (for a magnetic field $B=0$) is then reduced to the shaped volume 13 (for a magnetic field $B=B_0$) in FIG. 5*a* in which a rectilinear track for the plasma is formed by providing the coils 12*a*. The micro drops are then eliminated by the receptacles of the recessed systems 7 and extraction cups, such as 16, described hereinbefore.

In FIG. 5*b* a curved track for the plasma has been formed by placing the coils 12*b*. The diaphragm plates 14 which are provided according to this track along the walls ensure the elimination of the micro drops.

At the output of the system and in the absence of the magnetic field the plasma again expands at 15 and finds again the same elements as those which are present at the output of the anode of a structure without the separation means.

The embodiments of the invention shown should not be considered as being restrictive and it will be obvious that many variations are possible to those skilled in the art without departing from the scope of this invention.

What is claimed is:

1. A device comprising (a) a vacuum arc ion source including (i) a cathode, (ii) an anode separated from said cathode, and (iii) a plasma being emitted from said cathode, said cathode and said anode each being energized by respective potentials to form said plasma; and (b) means disposed relative to said anode for eliminating micro drops of molten material from said plasma.

2. A device according to claim 1, wherein said means include receptacles receiving said micro drops.

3. A device according to claim 2, wherein said receptacles include surfaces, said micro drops readily adhering to said surfaces.

4. A device according to claim 3 wherein said receptacles are polarized with respect to said cathode.

5. A device according to claim 4, wherein said receptacles include recessed spaces in a maximum emission zone of said micro drops.

6. A device according to claim 2 or claim 3 or claim 4 or claim 5, wherein said receptacles further include at least one grating having a plurality of cup-shaped members receiving said micro drops, said at least one grating being provided at or beyond said anode from said cathode.

7. A device according to claim 6, wherein said at least one grating is disposed to prevent direct observation of said cathode from said grating.

8. A device according to claim 6, wherein said means further includes separation means for separating micro drops from said plasma, said separation means providing a magnetic field, said magnetic field enclosing said plasma to restrict radial spreading of said plasma, and said magnetic field providing one of a rectilinear and a curved track of said plasma.

9. A device according to claim 1 or claim 2 or claim 3 or claim 4 or claim 5, wherein said means further includes separation means for separating micro drops from said plasma, said separation means providing a magnetic field, said magnetic field enclosing said plasma to restrict radial spreading of said plasma, and said magnetic field providing one of a rectilinear and a curved track of said plasma.

* * * * *